United States Patent [19]

Hawkins

[11] 4,213,250

[45] Jul. 22, 1980

[54] TEMPERATURE COMPENSATION FOR CLOTHES DRYER TIMER SELECTORS

[75] Inventor: Larry L. Hawkins, Louisville, Ky.

[73] Assignee: General Electric Company, Louisville, Ky.

[21] Appl. No.: 954,038

[22] Filed: Oct. 23, 1978

[51] Int. Cl.[2] ..... F26B 11/04

[52] U.S. Cl. ..... 34/53; 34/133; 73/362.5; 219/492

[58] Field of Search ..... 73/362.5, 362.7, 356, 73/362.8; 219/492, 493; 116/309, 221, 216, 316; 34/53, 45, 133

[56] References Cited

U.S. PATENT DOCUMENTS

| | | | |
|---|---|---|---|
| 3,122,358 | 2/1964 | Cobb et al. | 34/53 |
| 3,196,553 | 7/1965 | Deaton et al. | 34/53 |
| 3,242,585 | 3/1966 | Worst | 34/45 |
| 3,302,299 | 2/1967 | Scherzinger | 34/53 |
| 3,526,968 | 9/1970 | Triplett | 34/48 |

*Primary Examiner*—Larry I. Schwartz

*Attorney, Agent, or Firm*—Bruce A. Yungman; Radford M. Reams

[57] ABSTRACT

An ambient temperature compensation arrangement for clothes dryer cycle timers in which the timer dial reference for a particular operational cycle is shifted in correspondence with changes in ambient temperature. This compensates for changes in dryer run time required for proper drying with changes in ambient temperatures by causing a given timer dial to be set so as to be advanced or to retard the selected dryer cycle time. Specific arrangements disclosed include a movable reference pointer mounted on a spirally-wound bimetal, a thermometer related dial scale and a liquid crystal band marking on the timer dial scale.

3 Claims, 6 Drawing Figures

TEMPERATURE COMPENSATION FOR CLOTHES DRYER TIMER SELECTORS

BACKGROUND DISCUSSION

This invention concerns clothes dryers and more particularly cycle controls for controlling the duration of dryer operation.

Clothes dryer controls generally include a manually settable timer dial which is rotated to a given position for proper drying of the clothes in a given cycle. The position to which it is rotated basically operates to set a run time timer, which in turn at least partially controls the duration of the operating cycle of the dryer. The timer setting may directly control the length of drying time as indicated by a scale bearing a legend corresponding to the number of minutes the cycle is set by rotation to a particular scale marking on the dial scale. Alternatively, in automatic drying cycles, the dial scale reference marking merely indicates the start point of the automatic drying cycle.

The automatic controls then cause the operation of the dryer until the moisture content of the load has reached a certain predetermined level as directly sensed or indirectly determined by sensing parameters such as exhaust air temperature.

After achieving the predetermined level, the dryer time begins to time out the remaining segment of the dryer operating cycle.

The user, by rotating the dial to the start of the operating cycle, sets into the timer the fixed time interval of dryer operation after the moisture level has been reduced to the predetermined level.

The length of this time interval has been set in at normal conditions; that is, average dryer operating conditions. The duration of this interval is selected to achieve proper final moisture levels for the average conditions.

It has been discovered that the length of time of dryer operation in order to achieve a certain optimum final moisture level varies with room ambient temperature. That is, as room ambient temperatures decrease, the length of time of dryer operation required in order to achieve proper drying is reduced, whereas with increasing ambient temperatures, the length of time increases.

Thus, particularly in the automatic control situation, the user sets in a particular setting for a given operational cycle and there will be a tendency for either underdrying or overdrying of the load, except under the design normal or average operating conditions. This may effect the performance and efficiency of the dryer since dryers may be operated in a wide variety of ambient conditions.

It is accordingly the object of the present invention to provide an arrangement for compensating for such variations in ambient temperatures in the dial setting for the dryer timer such that the effects on dryer run time are automatically compensated so as to optimize the dryer operating times.

SUMMARY OF THE INVENTION

This and other objects of the present invention, which will become apparent upon a reading of the following specification and claims, are achieved by a special dial temperature shifted reference causing a variable setting of the dial position for a given operating cycle, shifting with variations in ambient temperature. The resulting changes in timer settings are in correspondence with ambient temperature conditions so as to shorten or lengthen the dryer cycle time. This shifting of the reference is carried out in several ways, including a movable reference pointer to which the timer dial is set for a given operating cycle, which pointer is mounted so as to shift in position with changes in ambient temperature by being mounted to a spirally-wound bimetal element.

The dial reference is alternatively combined with scale markings related to a thermometer positioned adjacent the dial reference scale, such that the user sets the timer to a different scale marking corresponding to the thermometer level.

A band scale consisting of a temperature-responsive liquid crystal is also utilized in which the user positions the dial in relationship to the relative position of a color in the liquid crystal.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
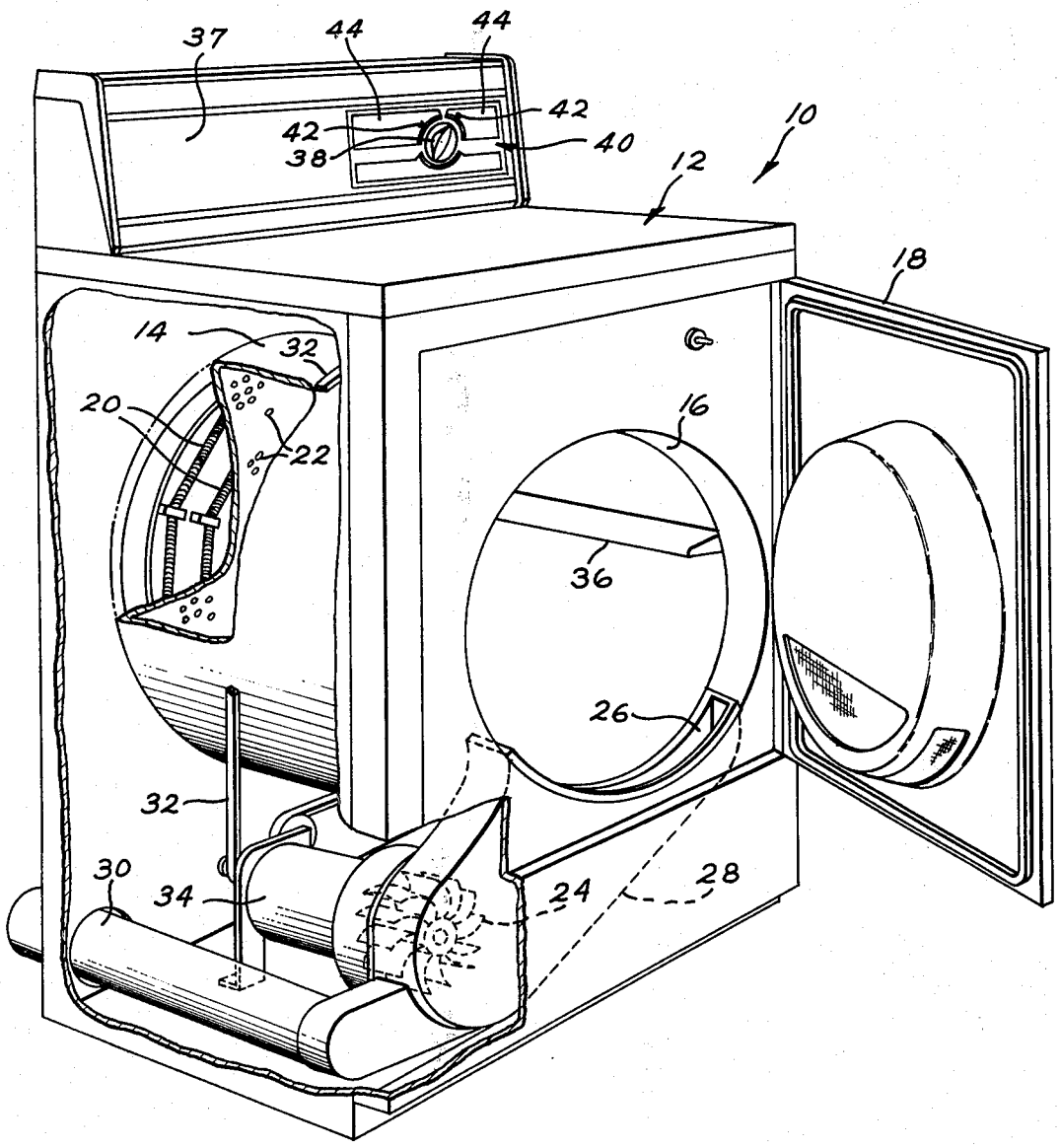
FIG. 1 is a perspective view of a clothes dryer equipped with a manually-settable control dial of the type with which the present invention is concerned.
Figure 2:
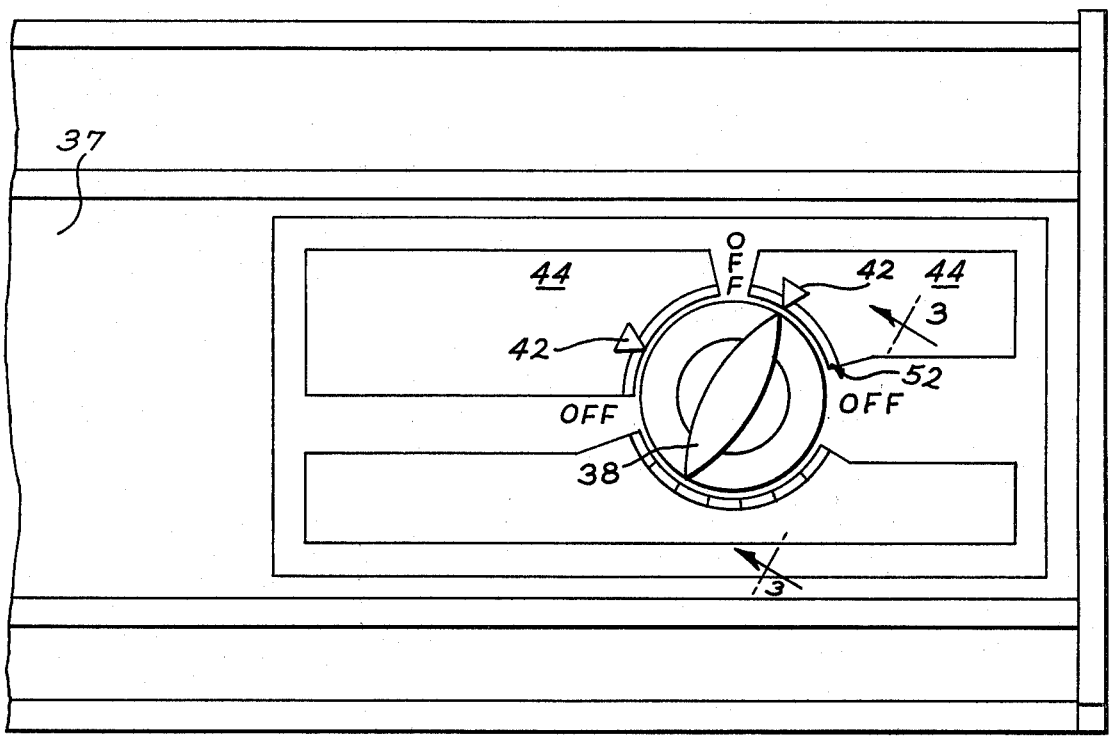
FIG. 2 is an enlarged elevational view of the control dial and associated reference scales.

Referring to the drawings, FIG. 1 depicts a conventional dryer 10 including a dryer cabinet 12 within which is rotatably mounted a drum 14 adapted to receive clothing articles to be dried through a front cabinet opening 16. A cabinet door 18 provides access to the interior of drum 14.

Electric heater elements 20 provide a source of heated air which is drawn in from the rear of the cabinet 12 and into the interior of the drum 14 through openings 22 formed in the rear surface of the drum 14. The heated air is drawn in by means of a blower 24 having an inlet opening 26 formed in the front of cabinet 12 at the bottom portion of the opening 16. The air is drawn through an exhaust duct 28 which communicates with an exhaust vent 30. The drum is rotated by means of a belt drive 32 extending about the exterior of the drum 14 and which may be driven by electric motor 34 which also serves to drive the blower 24.

Vanes 36 are provided in the interior of the drum 14 to insure proper tumbling of the clothing articles within the interior of drum 14 in the conventional manner.

Thus, the clothing articles placed within drum 14 are dried by a combination of air flow heat supplied by heater elements 20 and tumbling action provided by rotation of drum 14.

Electrical controls are provided in order to control the operation of the dryer for proper drying action. Such controls normally include a manually-settable control member such as a timer dial 38 which is rotated to a proper control setting in reference to a control dial reference 40. The user rotates the timer dial 38 to the proper setting for a given operational cycle.

Thus, for example, for the automatic drying cycle for normal drying, the user will manually rotate the dial to the start position of the scale marking, indicating the initiate position for that particular operational cycle.

According to the concept of the present invention, the timer dial 38 is positioned with respect to a shiftable reference pointer 42 with each reference scale 44 corresponding to a given operational cycle. The shiftable reference pointer 42 is mounted so as to move in correspondence with ambient temperature variations.

Thus, to initiate the cycle identified on the reference scale 44, the user is instructed to manually set the timer dial 38 to the shiftable reference pointer 42 to initiate the cycle. The arrangement mounting the shiftable reference pointer 42 shifts the position of the pointer in a direction tending to produce the correct setting of the timer to thereby shorten or lengthen the timed portion of the drying cycle in correspondence with the ambient temperatures as described above.

Figure 3:
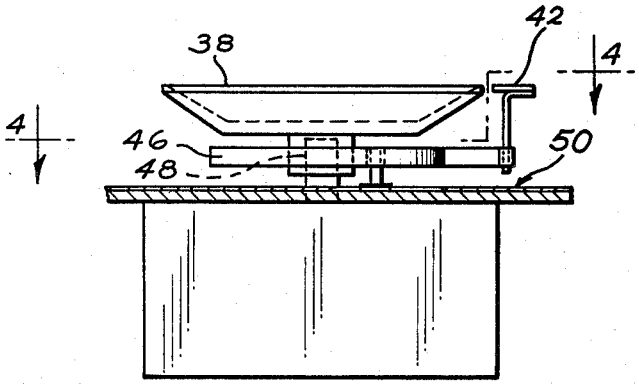
FIG. 3 is an enlarged view of the timer dial and associated movable dial reference arrangements taken along the direction of arrows 3—3 in FIG. 3.

Such a mounting arrangement is achieved by temperature compensation means for shifting the position of the shiftable reference pointer 42. Pointer 42 is shown in detail in FIGS. 3 and 4.

This includes the provision of a spirally-wound bimetal element 46 which is mounted concentrically to a stem 48 secured to the timer dial 38 and the timer mechanism. Bimetal element 46 is spirally wound such that changes in temperature tend to produce a relative rotation of the shiftable reference pointer 42 with respect to the switch trim 50 such that upon positioning of the timer dial 38 in correspondence with the pointer, the rotative position of the dial will be set at varying positions to compensate for temperature changes.

Figure 4:
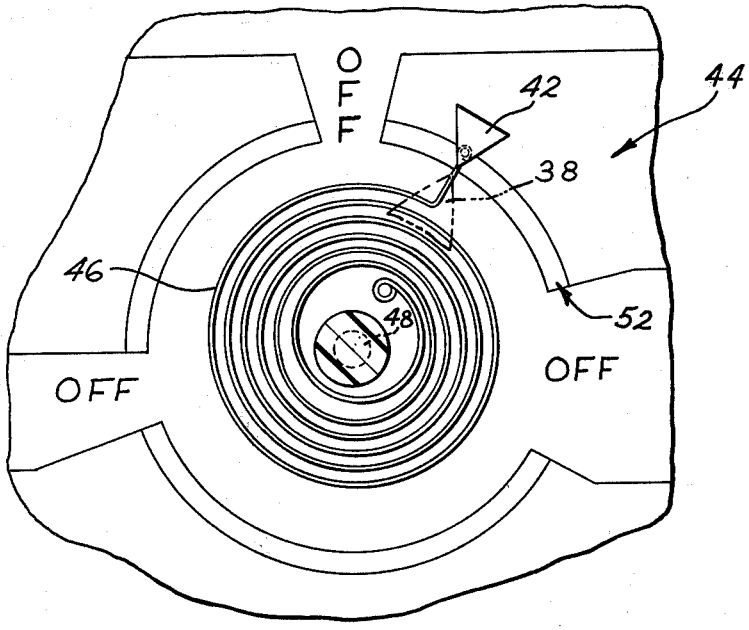
FIG. 4 is a view of the timer dial compensation reference depicted in FIGS. 2 and 3 taken along the direction of arrows 4—4 in FIG. 3.

As an example, as viewed in FIG. 4, it the timer dial 38 is advanced in a counterclockwise direction into zone 52, the timed interval of the dryer cycle is reduced.

Accordingly, the direction of wind of the spirally wound bimetal element 46 is such that as the temperature decreases, the shiftable reference pointer 42 is moved in a counterclockwise direction so that the duration of the cycle which is timer-controlled is reduced, thereby achieving the end results sought.

It will of course be appreciated that the compensation is only effective within a temperature range corresponding to the relative extreme positions of the pointer achievable by excursions of the bimetal element 46. That is, for ambient temperatures below or above the temperature range, further compensation is not effected. The bimetal element 46 is designed to compensate for normally encountered ambient temperature variations.

Figure 5:
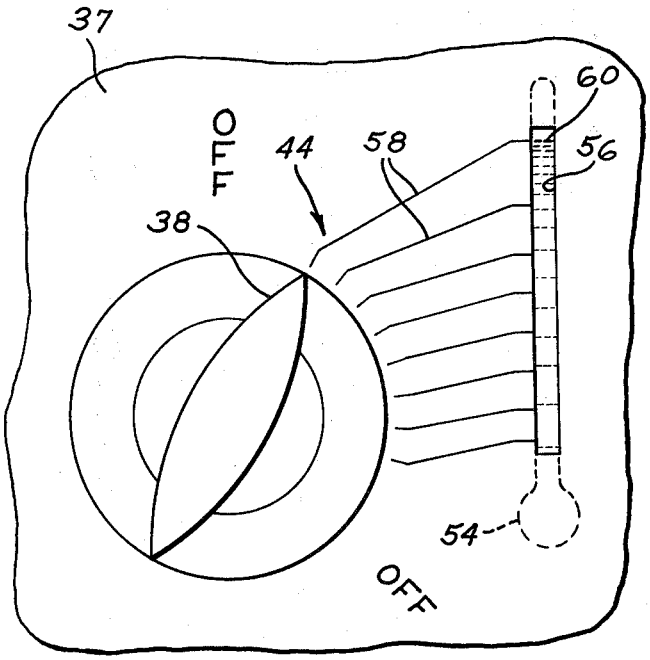
FIG. 5 is an elevational view of an alternate timer dial-reference scale arrangement.

Rather than a means for producing a reference pointer which is shifted in position, a thermometer reference scale may be employed as indicated in FIG. 5. This arrangement includes a conventional thermometer 54 in a viewing slot 56 formed in the control panel trim plate 37. Scale markings 58 are provided which are in alignment with the reference scales 44 at a given operational cycle such as to provide corresponding reference tick marks for manual setting of the timer dial 38. The user, observing the position of the meniscus of the thermometer liquid 60, chooses the closest corresponding scale marking 58, and interpolates the position therebetween.

The scale markings 58 are developed to produce a corresponding change in the timer start position for a given operation cycle. As depicted in FIG. 5, the timer advances or times out in the clockwise direction, such that as the level of liquid 60 becomes depressed due to a decrease in ambient temperature, the initial set position of the timer dial 38 is advanced to reduce the timed portion of the dryer cycle such as to offset the effects of changing ambient temperatures.

Figure 6:
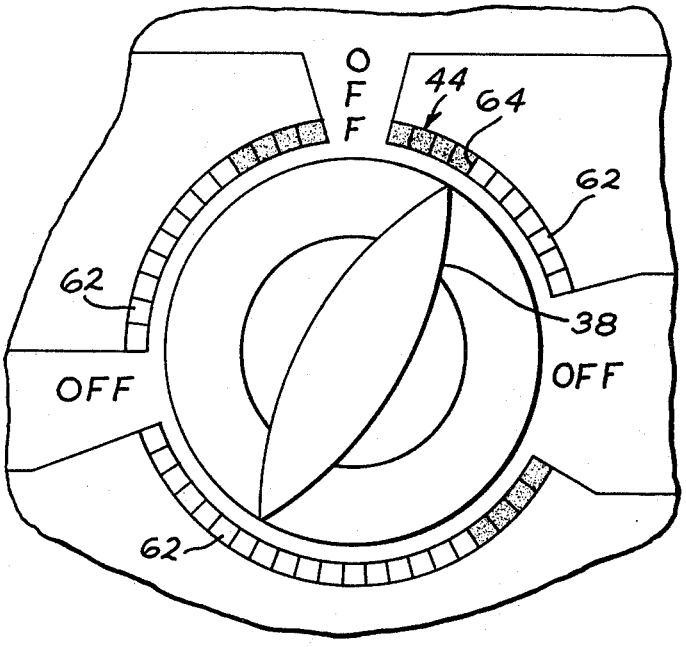
FIG. 6 is an enlarged elevational view of another variation of the timer dial compensation arrangement according to the present invention.

Another variation is depicted in FIG. 6 in which the scale of each corresponding operational cycle is occupied by a band of liquid crystal 62. The liquid crystal 62 is of a thermally-responsive type such as used in digital thermometers and produces a leading visible edge 64 which acts as a shiftable reference which moves with changes in temperature. In this case, the liquid crystal 62 shrinks so as to move the leading visible edge 64 in a clockwise direction such that the timer advance direction also selected to be in a clockwise direction. Thus, the timer dial 38 is rotated to advance the timer and decrease the dryer operation time with decreasing ambient temperature conditions.

Accordingly, it can be seen that the arrangement according to the present invention is relatively simple and trouble-free while achieving the primary objects sought, i.e., the optimization of the dryer operation in terms of efficiency of energy utilization and drying action on the clothes such that they are neither under or overdried. The compensation feature may be incorporated at relatively low cost in keeping with the highly competitive nature of home appliance markets.

While three different embodiments of this arrangement have been disclosed, those skilled in the art will recognize that a great many variations in the actual implementation of the concept are possible within the scope of this concept.

While the timer dial setting compensation is most advantageous in connection with the setting of the automatic cycles, the concept may also be applied to the minute scale of the timer. That is, the usual control device includes both automatic and purely-timed control dryer cycles. The user normally can himself compensate for the changes in room ambient temperature by varying the timed intervals set. However, the present arrangement could be utilized such that once the user learns a correct setting for given ambient temperatures, that setting will not vary with variations in room temperature.

The concept could also be applied to control dials for other equipment or systems subject to variations in performance with some varying parameter such as temperature. In this case, the varying parameter would affect an element to cause a corresponding shifting of the reference to cause an offset in the set position of the dial to eliminate the performance variations.

The embodiments of the invention in which an exclusive property or privilege is claimed are defined as follows:

1. A clothes dryer having at least one timer-controlled operational cycle for the drying of clothing articles placed therein, the control arrangement comprising:

timer means including a manually-settable control member and a reference, and means responsive to the setting of said control member with respect to said reference arranged to control the dryer run time of the operational cycle;

temperature compensation means including an element responsive to ambient room temperature and also including:

means cooperative between the temperature responsive element and said timer means to vary the dryer run time for said operational cycle for a given setting of said control member with respect to said reference in correspondence with changes in ambient temperature.

2. The clothes dryer according to claim 1 wherein said temperature compensation means includes means shifting said reference in response to said temperature-responsive element, whereby the manually set position of said control member is varied in correspondence with ambient room temperature.

3. The clothes dryer according to claim 2 wherein said reference comprises a thermally-responsive liquid crystal disposed in a band corresponding to the line of movement of said manually-settable control member, whereby said leading edge of said liquid crystal provides a reference pointer for manual setting of said control member.

* * * * *